US006666317B2

(12) United States Patent
Harris

(10) Patent No.: US 6,666,317 B2
(45) Date of Patent: Dec. 23, 2003

(54) MULTIPLE COIN SLOT

(76) Inventor: Thomas Frank Harris, P.O. Box 1116, Ardmore, OK (US) 73042

( * ) Notice: Subject to any disclaimer, the term of this patent is extended or adjusted under 35 U.S.C. 154(b) by 259 days.

(21) Appl. No.: 10/007,809

(22) Filed: Nov. 8, 2001

(65) Prior Publication Data

US 2003/0085100 A1 May 8, 2003

(51) Int. Cl.[7] ..... G07F 5/06; G07F 17/04
(52) U.S. Cl. ..... 194/235
(58) Field of Search ..... 473/1; 194/225, 194/229, 234, 235, 237, 238, 350

(56) References Cited

U.S. PATENT DOCUMENTS 3,732,962 A 5/1973 Hall
3,871,504 A * 3/1975 Anesi et al. ..... 194/235
4,098,385 A 7/1978 McNally
4,119,192 A * 10/1978 Hickman ..... 194/235
4,221,285 A * 9/1980 Greenwald et al. ..... 194/238
4,350,240 A 9/1982 Gitlin et al.
4,382,499 A * 5/1983 Christian ..... 194/225
4,401,202 A 8/1983 Gitlin et al.
4,499,983 A 2/1985 Gitlin et al.
4,502,584 A 3/1985 Lambiris
4,509,630 A 4/1985 Mongelli
4,515,262 A 5/1985 Wilfong et al.
4,640,405 A 2/1987 Hall
4,799,580 A 1/1989 Hall
4,977,995 A 12/1990 Hall
5,074,396 A * 12/1991 Gitlin et al. ..... 194/200
5,411,125 A * 5/1995 Hiortdahl ..... 194/202

* cited by examiner

*Primary Examiner*—Donald P. Walsh
*Assistant Examiner*—Kenneth W. Bower
(74) *Attorney, Agent, or Firm*—Dunlap, Codding & Rogers, P.C.

(57) ABSTRACT

A coin slide which accepts a plurality of smaller denomination coins or single larger denomination coin preferably equal in value to total value of the plurality of smaller denomination coins, in lieu of the plurality of small denomination coins. The coin slide includes a body, a slide, a bridge and a lever checking mechanism.

18 Claims, 6 Drawing Sheets

MULTIPLE COIN SLOT

BACKGROUND OF THE INVENTION

1. Field of the Invention

The present invention relates generally to coin accepting mechanisms for use in the vending machine industry, and more particularly, but not by way of limitation, to a coin slide adapted to be secured to a vending machine for authorizing activation of the vending machine upon receipt of a predetermined plurality of smaller denomination coins of predetermined size and value or a larger denomination coin of predetermined size and value in lieu of the plurality of smaller denomination coins.

2. Brief Discussion of the Related Art

Coin slides have long been utilized in the vending machine industry to accept coins, to check the coins for denomination and authenticity prior to vending, and then to receive and store the coins following vending for later collection by the owner or manager of the establishment. As prices have risen and as vending operations have become more costly, coin slides capable of accepting increased numbers of coins have been manufactured and made available to the public.

However, a problem encountered with the use of coin slides is that after they have been set up to accept a specific amount of money, a certain number and denomination of coins is required to operate the coin slide. For example, if the vending machine is set up to require a dollar, the coin slide will typically be set up to accept four quarters to make up this dollar. Thus, if a customer does not have four quarters but does have a dollar coin, the customer must get change for the dollar coin for operating the vending machine. This is not only an inconvenience to a potential customer, but can result in loss sales to the vendor if the customer is not able to quickly and easily obtain the required change or if the customer simply chooses not to attempt to obtain the required change.

To this end, a need exists for a coin slide which allows a coin slide user the option of utilizing either a plurality of smaller denomination coins or a single large denomination coin of equal value in lieu of the plurality of smaller denomination coins. It is to such a coin slide that the present invention is directed.

BRIEF DESCRIPTION OF THE SEVERAL VIEWS OF THE DRAWINGS

FIG. 6 is a cross-sectional view of the coin slide in a slide catch position.

FIG. 8 is a cross-sectional view of the coin slide and a larger denomination coin with the slide of the coin slide positioned between the coin receiving position and the vending position and in the slide release position.

DETAILED DESCRIPTION OF THE INVENTION

Figure 1:
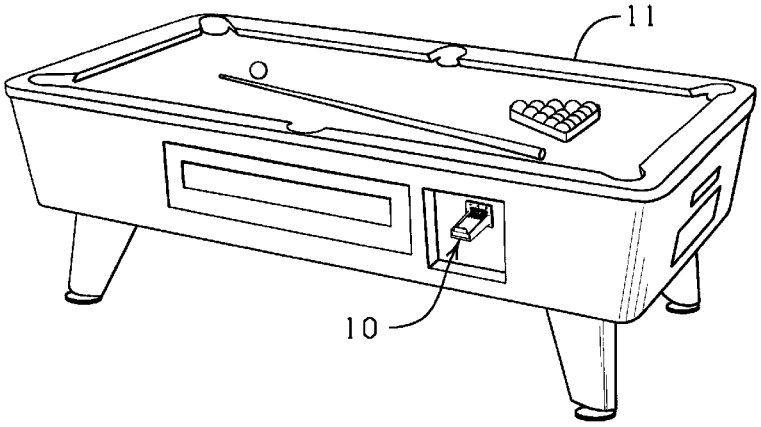
FIG. 1 is a perspective view of a coin slide constructed in accordance with the present invention shown installed in a vending type pool table.
Figure 3:
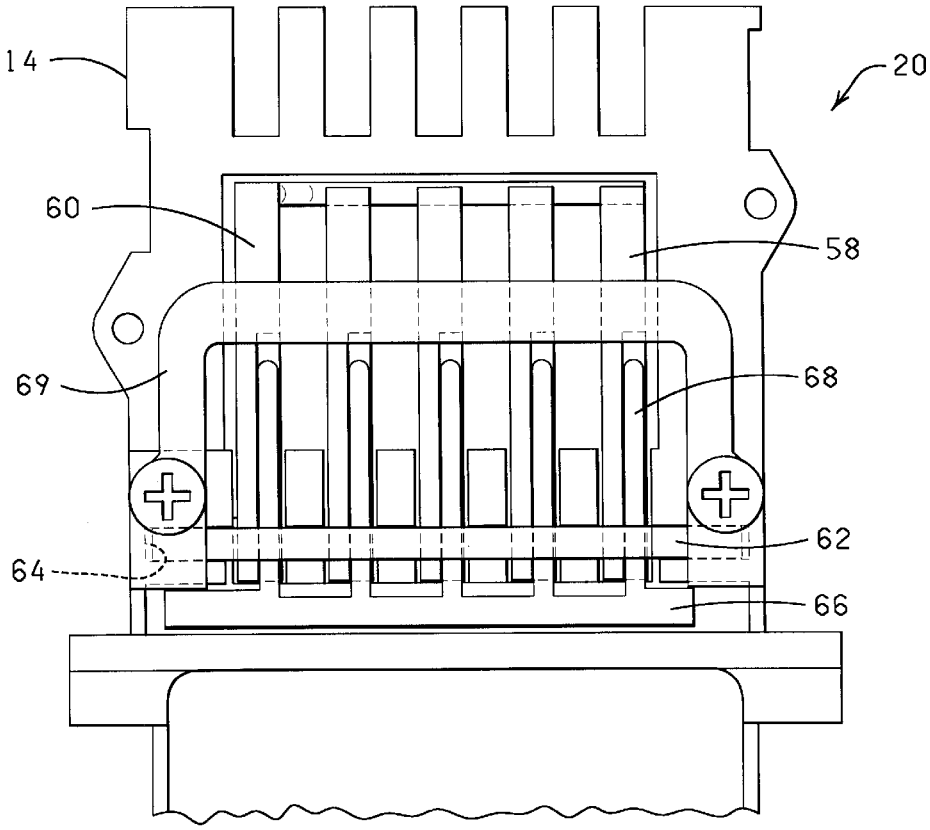
FIG. 3 is a bottom plan view of the lever checking mechanism of the coin slide of FIG. 1.

Referring now to the drawings, and more particularly to FIG. 1, a coin slide 10 constructed in accordance with the present invention is shown mounted in a pool table 11. The coin slide 10 of the present invention is also suitable for initiating the vending cycle in other vending machines that employ a coin slide extending from the vending machine, such as washing machines and dryers.

Figure 2:
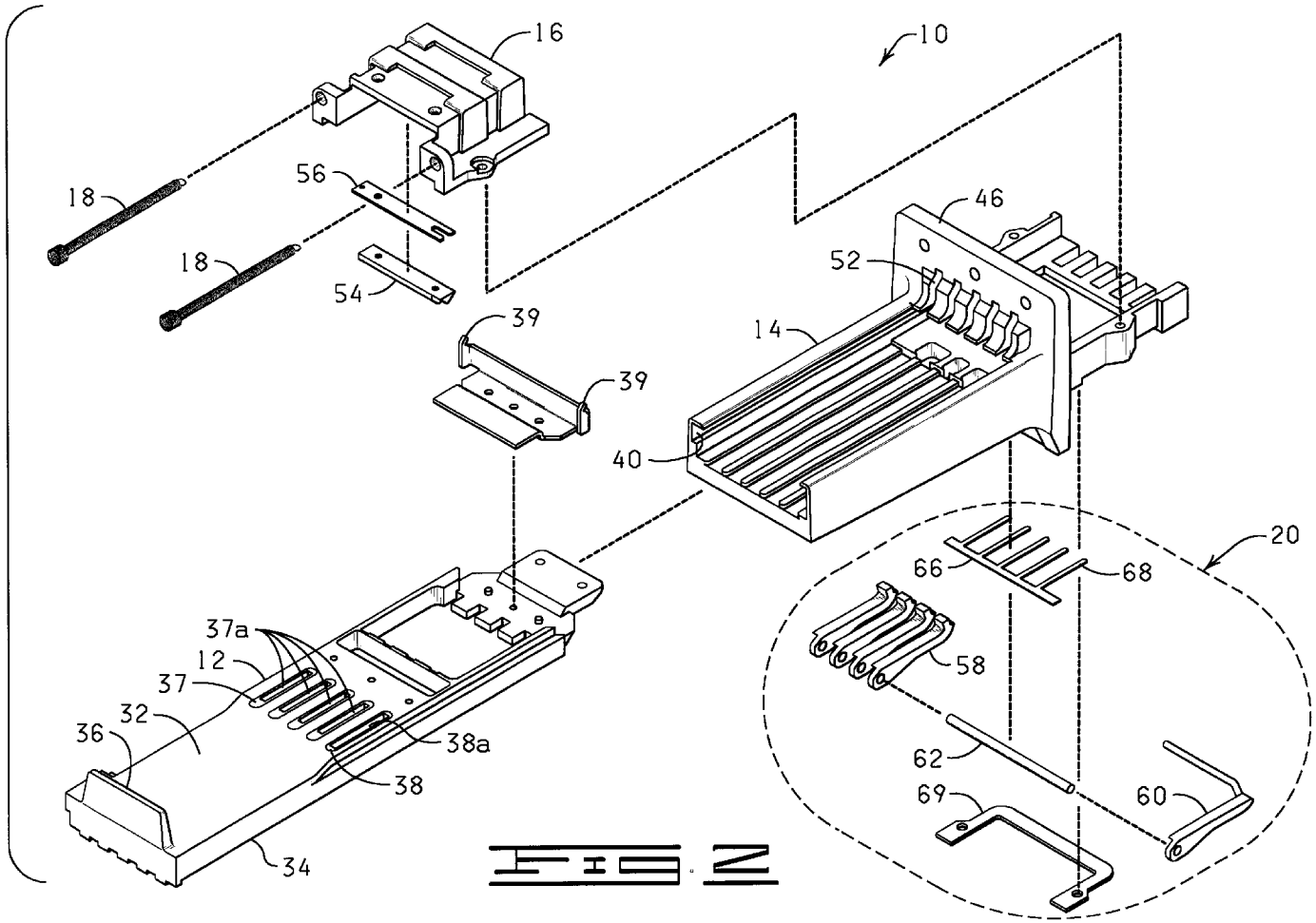
FIG. 2 is an exploded, perspective view of the coin slide of FIG. 1.

Referring now to FIG. 2, the coin slide 10 generally includes a slide 12, a body 14, a bridge 16, a pair of operating springs 18, and a lever checking mechanism 20. The slide 12 has an upper surface 32, a lower surface 34 and a handle 36. The slide 12 is further adapted to receive a plurality of interchangeable cores 37 and 38, each of which is provided with a coin receiving opening or slot 37*a* and 38*a*, respectively, of sizes and configuration to receive a coin of a specified denomination. Each interchangeable core 37 and 38 has a locking edge 37*b* and 38*b*, respectively (FIGS. 6–8), the function of which will be discussed below. For instance, four smaller denomination coin receiving openings 37*a* can be suitable for accepting quarters and the single large denomination coin receiving opening 38*a* can be suitable for accepting a dollar coin. The slide 12 is dimensioned and configured to be movable longitudinally along a slide passageway 40 in the body 14 of the coin slide 10 between a forward coin accepting position and a rearward vending position. As the slide 12 moves longitudinally along the slide passageway 40, a portion of the slide 12 traverses beneath the bridge 16 which is secured to the body 14 of the coin slide 10. The pair of operating springs 18 are biased between a pair of lugs 39 which are rearwardly affixed on the slide 12 and the bridge 16. The pair of operating springs 18 normally bias the slide 12 to the initial, forward coin accepting position. When the slide 12 is urged rearwardly toward a vending position, the bias of the springs 18 must be overcome by rearwardly directed forces on the handle 36 applied by the hand of the user (not shown) in a well known manner.

As mentioned above, the slide passageway 40 of the body 14 is configured and dimensioned to accept the slide 12. The body 14 also has an integral mounting flange 46 for securing the coin slide 10 to a front panel of a vending machine such as the pool table 11 shown in FIG. 1. The mounting flange 46 is equipped with a plurality of coin receiving grooves 52 in longitudinal alignment with the central axis of the plurality of small denomination and large denomination coin receiving openings 37*a* and 38*a*, respectively, provided in the slide 12. The coin receiving grooves 52 and the small denomination and large denomination coin receiving openings 37*a* and 38*a* are disposed and aligned such that coins can be inserted into the small denomination and large denomination coin receiving openings 37*a* and 38*a* in the slide 12 and moved through their respective coin receiving grooves 52 in the mounting flange 46 with minimal resistance to rearward movement of the slide 12 toward initiation of the vending cycle.

If the coin is appropriately dimensioned (i.e., of appropriate denomination) to fit into the small denomination and large denomination coin receiving openings 37*a* and 38*a* and through the respective coin receiving grooves 52 a first and second shaped interior surface 54 (FIG. 7) and 56 (FIG. 8) of the bridge 16 function to force the coins downwardly at least partially through the small denomination and large denomination coin receiving openings 37*a* and 38*a* of the slide 12 as the slide 12 is pushed to feed the coins rearwardly of the mounting flange 46 through the coin receiving grooves 52 therein. It should be noted that the first shaped interior surface 54 of the bridge 16 is configured and sized such that the small denomination coins will fit underneath and will be forced downwardly through the large denomination coin receiving opening 37*a* and a second shaped interior surface 56 of the bridge 16 is configured and sized such that the large denomination coin will fit beneath and will be forced downwardly through the small denomination coin receiving opening 38*a* as the slide 12 is pushed toward the vending position.

Referring now to FIGS. 2, 3 and 6–8, the lever checking mechanism 20 is connected to the body 14 below the bridge 16 and includes a plurality of small denomination coin checking levers 58, a large denomination coin checking lever 60, and a pivot pin 62 which fits into a pivot pin recess 64 on the body 14 (FIG. 3) of the coin slide 10. A leaf spring 66 having a plurality of leaf spring fingers 68 is provided for biasing the small denomination and large denomination coin checking levers 58 and 60 in a slide catching position (FIG. 6) such that the small denomination coin checking levers 58 engage the locking edges 37*b* of the interchangeable cores 37 to selectively prevent the slide 12 from moving to the vending position. The small denomination coin checking levers 58 are configured and positioned to be moved by smaller denomination coins positioned in the small denomination coin receiving openings 37*a* of the slide 12 as the slide 12 is moved from the coin accepting position to the vending position. In the slide catch position, illustrated in FIG. 6, at least one of the small denomination coin checking levers 58 engages locking edges 37*b* of the interchangeable cores 37 of the slide 12 so as to prevent the slide 12 from passing to the vending position. In the slide release position, the small denomination coin checking levers 58 are positioned to permit the slide 12 to pass to the vending position. The lever checking mechanism 20 further includes a stop member 69 which acts as a limit for the small denomination coin checking levers 58.

Figure 4:
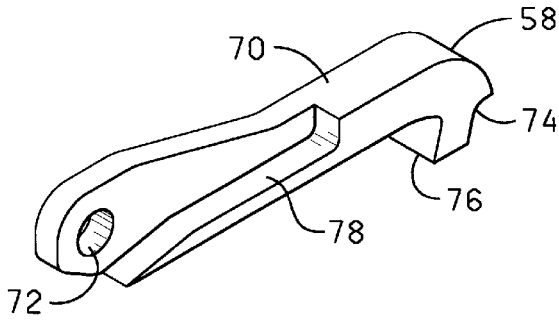
FIG. 4 is a perspective view of a small denomination lever of the lever checking mechanism of FIG. 3.

As best shown in FIG. 4, each of the small denomination coin checking levers 58 includes a main body 70 having a pivot pin opening 72 on the proximal end thereof dimensioned and configured to accept the pivot pin 62 (FIG. 2) and a notch 74 formed on the distal end of the small denomination coin checking lever 58. Each of the small denomination coin checking levers 58 further has a hook 76 on the distal end of the small denomination coin checking lever 58 designed to selectively engage and disengage the plurality of locking edges 37*b* of the interchangeable cores 37 so as to respectively restrain the slide 12 from progressing to the vending position. Each small denomination coin checking lever 58 also has a leaf spring recess 78 for accepting one of the leaf spring fingers 68.

Figure 5:
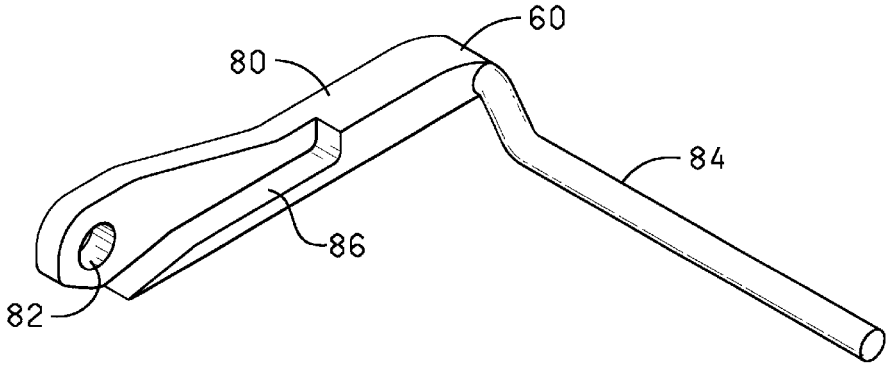
FIG. 5 is a perspective view of a large denomination lever of the lever checking mechanism of FIG. 3.
Figure 5:
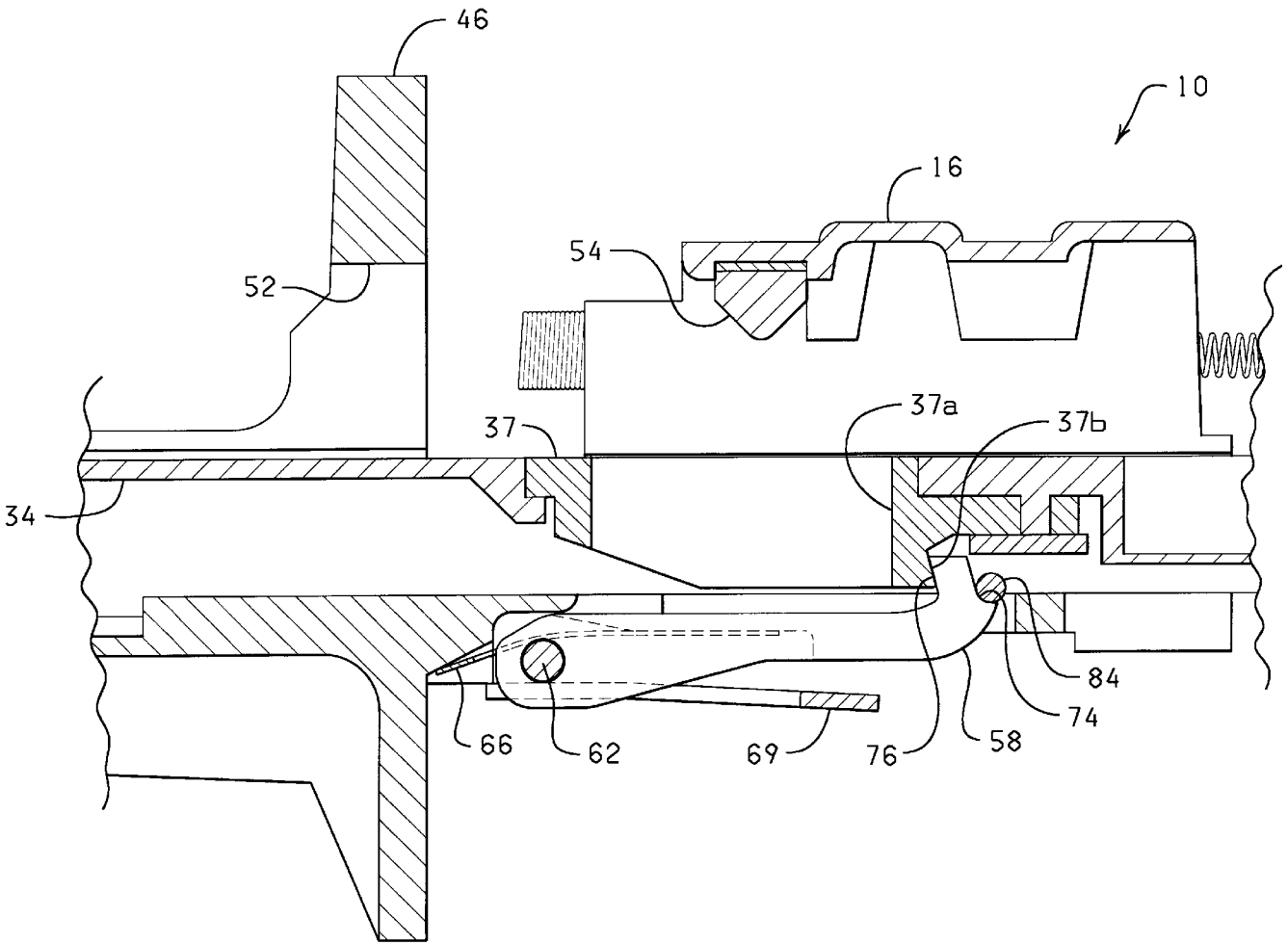

Referring now to FIG. 5, the large denomination coin checking lever 60 is substantially L shaped and includes a main body 80, a pivot pin opening 82 on the proximal end of the main body 80 dimensioned and configured to accept the pivot pin 62, and a bar 84 extending in a perpendicular direction from the distal end of the main body 80. The bar 84 is positioned to engage each of the small denomination coin checking levers 58, when the large denomination coin checking lever 60 is moved to the slide release position such that the small denomination coin checking levers 58 are positioned to permit the slide 12 to pass to the vending position as if the correct number of smaller denomination coins had been inserted into the small denomination coin receiving opening 37*a*. The bar 84 is connected to the body 14 and aligned so as to be accepted by the notches 74 (FIG. 4) in the distal ends of the small denomination coin checking levers 58. The large denomination coin checking lever 60 further has a leaf spring recess 86 for accepting one of the leaf spring fingers 68. Although the large denomination coin checking lever 60 is shown and described herein as being substantially L shaped and disposed in the right most lever checking position of the lever checking mechanism 20, those skilled in the art will readily recognize and understand that the shape of the large denomination coin checking lever 60 and the position of the large denomination coin checking lever can vary. For example, the large denomination coin checking lever 60 and large denomination coin checking coin receiving opening 38*a* can be substantially centrally located in the coin slide 10 and the large denomination coin checking lever 60 can be substantially T shaped.

Figure 7:
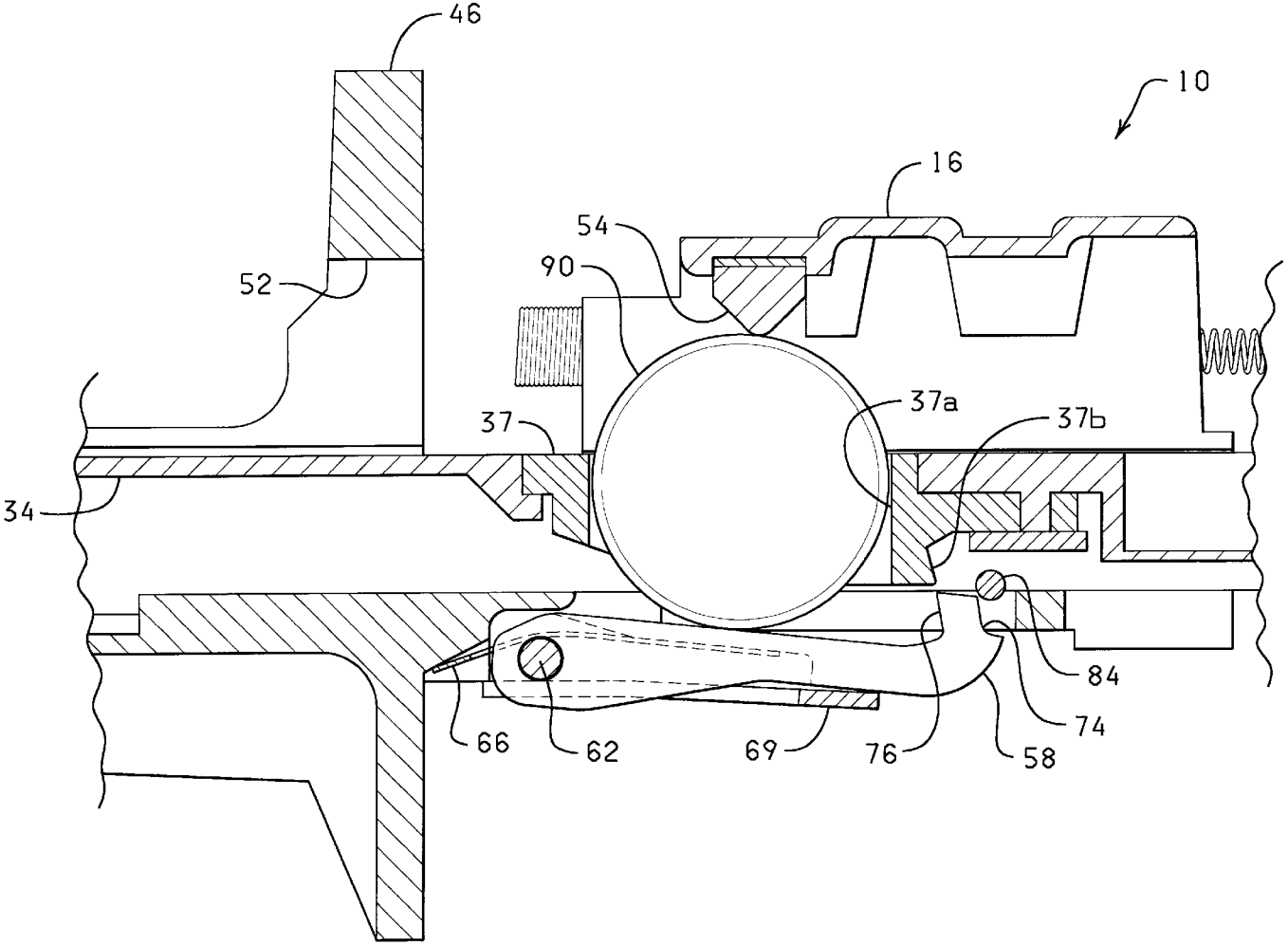
FIG. 7 is a cross-sectional view of the coin slide and a smaller denomination coin with the slide of the coin slide positioned between a coin receiving position and a vending position and in a slide release position.
Figure 5:
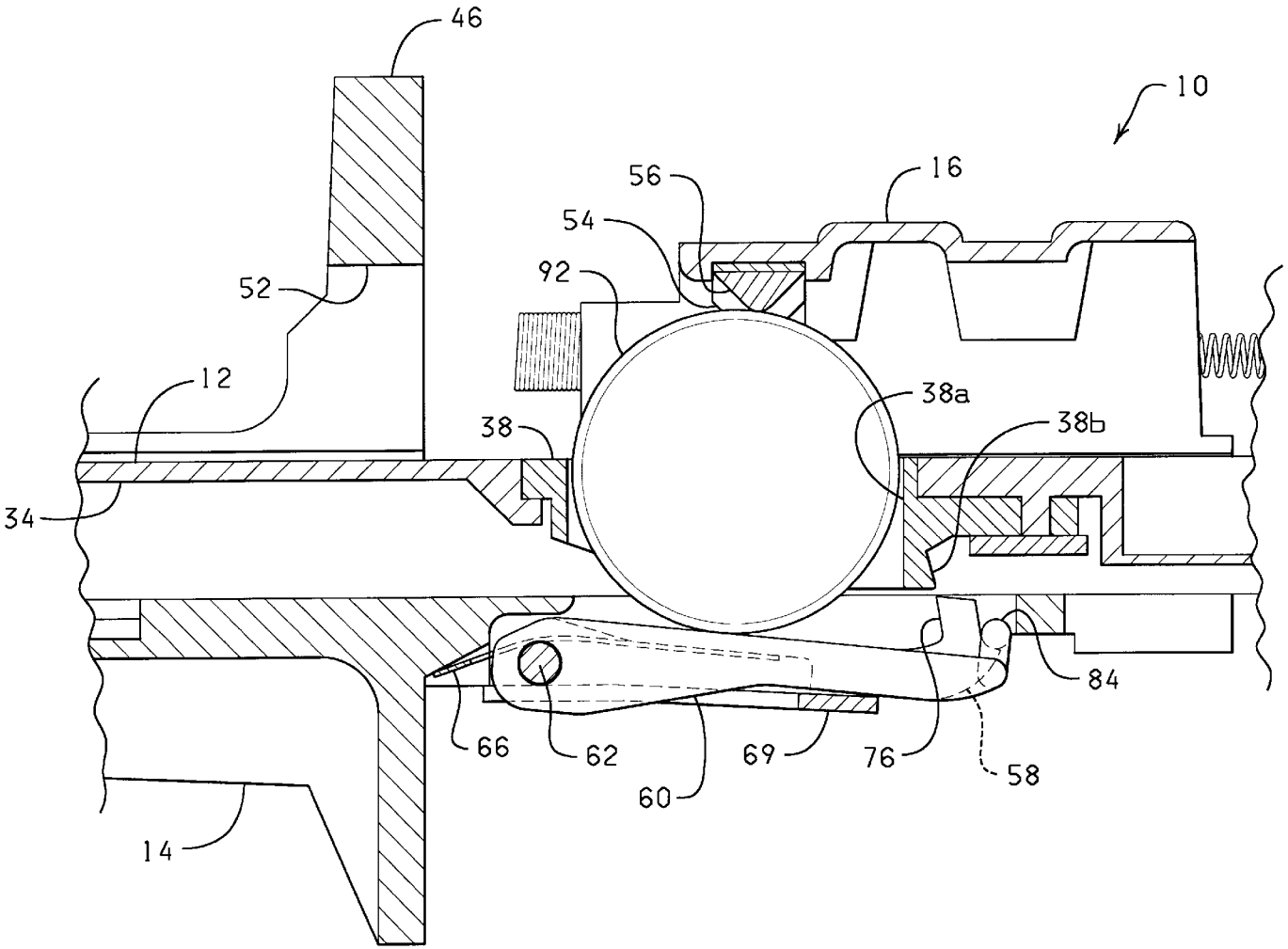

Referring now to FIG. 7 shown therein is a smaller denomination coin 90 inserted into the small denomination coin receiving opening 37*a* of the slide 12 and the slide 12 positioned between the coin receiving position and the vending position. By way of example, the coin slide 10 may be set up to operate upon receiving one dollar. As such, the coin slide 10 would require that four quarters be positioned in the small denomination coin receiving openings 37*a* (only one of the small denomination coins 90 being depicted in FIG. 7). In operation, the smaller denomination coins 90 pass through the coin receiving grooves 52 in the mounting flange 46 of the body 14 and under the bridge 16 as the slide 12 is moved from the coin receiving position. The downward pressure exerted by each smaller denomination coin 90 acts upon the small denomination coin checking levers 58 against the bias of a leaf spring finger 68 disposed in the leaf spring recess 86 of the small denomination coin checking lever 58 to pivot each small denomination coin checking lever 58 about the pivot pin 62 and depress the hooks 76 on the small denomination coin checking lever 58 downwardly until the hooks 76 of each small denomination coin checking lever 58 are urged downwardly below the plurality of locking edges 37*b* of the interchangeable cores 37 on the lower surface 34 of the slide 12. When the hooks 76 of the small denomination coin checking levers 58 have been moved free of engagement with the plurality of locking edges 37*b*, the slide 16 can then be pushed further rearwardly toward the vending position. As the slide 12 is moved further toward the vending position, the smaller denomination coins 90 fall through the small denomination coin receiving openings 37*a* into a coin box (not shown) for later collection in a known manner.

If a smaller denomination coin 90 is not disposed in each of the small denomination coin receiving openings 37*a*, the leaf spring finger 68 corresponding to the small denomination coin receiving opening 37*a* in which no coin is disposed will bias the small denomination coin checking lever 58 such that the hook 76 on the distal end of the small denomination coin checking lever 58 will engage the corresponding locking edge 37*b* and prevent the slide 12 from being moved into the vending position, as illustrated in FIG. 6. It should be noted that the distal end of the large denomination coin checking lever 60 is not provided with a hook to prevent the slide 12 from moving into the vending position. Thus, the absence of a large denomination coin in the large denomination coin receiving opening 38*a* will not prevent the slide 12 from being moved toward the vending position.

FIG. 8 shows a single larger denomination coin 92, which is of equal value to the sum of the values of the plurality of smaller denomination coins 90 disposed in the large denomination coin receiving opening 38*a* of the slide 12. The larger denomination coin 92 is utilized in lieu of a plurality of smaller denomination coins 90. By way of example, the larger denomination coin 92 may be a dollar coin which would be used in lieu of four quarters if the coin slide 10 is set up to operate upon receiving a dollar. The large denomination coin checking lever 60 is configured and positioned to be moved by the large denomination coin 92 positioned in the large denomination coin receiving opening 38*a* of the slide 12 as the slide 12 is moved toward the vending position from the coin receiving position and thereby moving the large denomination coin checking lever 60 from the slide catch position (FIG. 6) to the slide release position (FIG. 8).

As previously mentioned, in the slide catch position at least one of the small denomination coin checking levers 58 engage the slide 12 so as to prevent the slide from passing from the coin receiving position to the vending position. When the large denomination coin checking lever 60 is in the slide release position, the large denomination coin checking lever 60 communicates with each of the small denomination coin checking levers 58 and causes each of the small denomination coin checking levers 58 to be positioned so as to permit the slide 12 to pass from the coin receiving position to the vending position as if the appropriate number of smaller denomination coins had been inserted into the small denomination coin receiving opening 37*a*.

In operation, the single larger denomination coin 92 is inserted into the large denomination coin receiving opening 38*a* to allow movement of the slide 12 toward the vending position as the slide 12 is moved in a direction toward the vending position. The single larger denomination coin 92 passes through the coin receiving grooves 52 in the mounting flange 46 of the body 14 and as the larger denomination coin 92 progresses toward the vending position and passes beneath the second shaped interior surface 56 of the bridge 16 affixed to the body 14 of the coin slide 10. The downward pressure exerted by the larger denomination coin 92 acts upon the large denomination coin checking lever 60 against the bias of the respective leaf spring finger 68 of the leaf spring 66 positioned in the leaf spring recess 86 of the large denomination coin checking lever 60 to pivot the large denomination coin checking lever 60 about the pivot pin 62. As the large denomination coin checking lever 60 pivots downward, the bar 84 which extends in a perpendicular direction from the distal end of the main body 80 of the large denomination coin checking lever 60 engages the distal ends of the small denomination coin checking levers 58 and depresses each of the small denomination coin checking levers 58 until the hook 76 of each small denomination coin checking lever 58 is urged downwardly below the locking edges 37*b* of the interchangeable cores 37 of the slide 12. When each of the small denomination coin checking lever 58 has been moved free of engagement with the locking edges 37*b*, the slide 12 can then be pushed further rearwardly toward the vending position. As the slide 12 is moved further towards the vending position, the larger denomination coin 92 is allowed to fall through the large denomination coin receiving opening 38*a* into a coin box (not shown) for later collection in a known manner and the slide progress to make appropriate contact with the vending machine and thereby authorize activation of the vending machine.

Certain features have been designed to render the vertical type coin slides capable of rapid and easy price adjustment, such as set forth in U.S. Pat. Nos. 4,350,240, 4,401,202 and 4,499,983, the specifications of which are hereby expressly incorporate herein by reference. These features allow vending machine operators to adjust the coin slides as necessary to either increase the vending price or to lower the vending price, in accordance with day-to-day market place requirements. Interchangeable cores have been designed in the devices of the prior patents for storage of suitable parts directly within the coin slides in a manner which enables an operator to adjust the vending price without requiring major disassembly of the component parts of the coin slide. Those skilled in the art will readily understand that such features can be utilized in combination with the present invention.

Furthermore, U.S. Pat. Nos. 4,350,240, 4,401,202 and 4,499,983 additionally have incorporated many construction features which were particularly designed to minimize the acceptance of bad coins and to discourage tampering. Those skilled in the art will readily understand that such features can also be utilized in combination with the present invention.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. A coin slide adapted to be secured to a vending machine for authorizing activation of the vending machine upon receipt of a predetermined plurality of smaller denomination coins of predetermined size and value or a larger denomination coin of predetermined size and value in lieu of the plurality of smaller denomination coins, the coin slide comprising:

a body adapted to be connected to the vending machine, the body having a slide passageway;

a slide moveable along the slide passageway of the body between a forward coin accepting position and a rearward vending position, the slide having a plurality of smaller denomination coin receiving openings configured to receive smaller denomination coins and a larger denomination coin receiving opening configured to accept a larger denomination coin;

a plurality of small denomination coin levers connected to the body and configured and positioned to be moved by smaller denomination coins positioned in the smaller denomination coin receiving opening of the slide as the slide is moved toward the vending position from the coin receiving position from a slide catch position to a slide release position, in the slide catch position at least one of the small denomination coin levers engages the slide so as to prevent the slide from passing to the vending position while in the slide release position each of the small denomination coin levers are positioned to permit the slide to pass to the vending position; and a large denomination coin lever connected to the body and configured and positioned to be moved by a larger denomination coin positioned in the large denomination coin receiving opening of the slide as the slide is moved toward the vending position from the coin receiving position from a slide catch position to a slide release position, in the slide catch position of the large denomination coin lever at least one of the small denomination coin levers engages the slide so as to prevent the slide from passing to the vending position while in the slide release position of the large denomination coin lever the large denomination coin lever communicates with each of the small denomination coin levers causing each of the small denomination coin levers to be positioned to permit the slide to pass to the vending position as if the plurality of smaller denomination coins had been inserted into the smaller denomination coin openings of the slide such that the slide is permitted to be moved from the coin receiving position to the vending position by inserting the larger denomination coin into the slide in lieu of the plurality of smaller denomination coins.

2. The coin slide of claim 1 wherein large denomination coin lever has a bar on one end thereof positioned to engage each of the small denomination coin levers when the large denomination coin lever is moved to the slide release position thereby causing each of the small denomination coin levers to be positioned to permit the slide to pass to the vending position as if the plurality of smaller denomination coins had been inserted into the smaller denomination coin openings of the slide.

3. The coin slide of claim 2 wherein each of the small denomination coin levers includes a notch on one end thereof for receiving the bar of the large denomination lever.

4. The coin slide of claim 3 wherein each of the small denomination coin levers is biased in the slide catch position and wherein the large denomination coin lever is biased in the slide catch position.

5. The coin slide of claim 1 wherein the slide has four small denomination coin receiving openings and wherein each of the small denomination coins has a value of twenty-five cents.

6. The coin slide of claim 5 wherein the large denomination coin receivable in the large denomination coin receiving space has a value of one dollar.

7. A coin slide adapted to be secured to a vending machine for authorizing activation of the vending machine upon receipt of a predetermined plurality of smaller denomination coins of predetermined size and value or a larger denomination coin of predetermined size and value in lieu of the plurality of smaller denomination coins, the coin slide comprising:

a body having a slide passageway and an integral mounting flange for securing the coin slide to the vending machine, the mounting flange having a plurality of coin receiving grooves;

a slide moveable along the slide passageway in the body between a forward coin receiving position and a rearward vending position, the slide having a plurality of smaller denomination coin receiving openings configured to receive smaller denomination coins and a larger denomination coin receiving opening configured to accept a larger denomination coin, the coin receiving grooves of the mounting flange in alignment with the smaller denomination coin receiving openings and the larger denomination coin receiving opening such that coins disposed in the smaller denomination coin receiving openings and a coin disposed in the larger coin receiving opening pass through the coin receiving grooves as the slide is moved from the forward coin receiving position to the rearward vending position;

a bridge secured to the body such that the slide is movable below the bridge, the bridge having a first interior shaped surface and a second interior shaped surface;

a plurality of small denomination coin levers connected to the body and configured and positioned to be moved by smaller denomination coins as the smaller denomination coins pass under the first interior shaped surfaces of the bridge from a slide catch position to a slide release position, in the slide catch position at least one of the small denomination coin levers engages the slide so as to prevent the slide from passing to the vending position while in the slide release position each of the small denomination coin levers are positioned to permit the slide to pass to the vending position; and a large denomination coin lever connected to the body and configured and positioned to be moved by a larger denomination coin as the larger denomination coin passes under the second interior shaped surface of the bridge from a slide catch position to a slide release position, in the slide catch position of the large denomination coin lever at least one of the small denomination coin levers engages the slide so as to prevent the slide from passing to the vending position while in the slide release position of the large denomination coin lever the large denomination coin lever communicates with each of the small denomination coin levers causing each of the small denomination coin levers to be positioned to permit the slide to pass to the vending position as if the plurality of smaller denomination coins had been inserted into the smaller denomination coin openings of the slide such that the slide is permitted to be moved from the coin receiving position to the vending position by inserting the larger denomination coin into the slide in lieu of the plurality of smaller denomination coins.

8. The coin slide of claim 5 wherein large denomination coin lever has a bar on one end thereof positioned to engage each of the small denomination coin levers when the large denomination coin lever is moved to the slide release position to cause each of the small denomination coin levers to be positioned to permit the slide to pass to the vending position as if the plurality of smaller denomination coins had been inserted into the smaller denomination coin openings of the slide.

9. The coin slide of claim 8 wherein each of the small denomination coin levers includes a notch on one end thereof for receiving the bar of the large denomination lever.

10. The coin slide of claim 9 wherein each of the small denomination coin levers is biased in the slide catch position and wherein the large denomination coin lever is biased in the slide catch position.

11. The coin slide of claim 7 wherein the slide has four small denomination coin receiving openings, and wherein each of the small denomination coins has a value of twenty-five cents.

12. The coin slide of claim 11 wherein the large denomination coin receivable in the large denomination coin receiving space has a value of one dollar.

13. A lever checking mechanism for use with a coin slide adapted to be secured to a vending machine for authorizing activation of the vending machine upon receipt of a predetermined plurality of smaller denomination coins of predetermined size and value or a larger denomination coin of predetermined size and value in lieu of the plurality of smaller denomination coins, the coin slide including a body adapted to be connected to the vending machine and a slide moveable along the body between a forward coin receiving position and a rearward vending position, the slide having a plurality of smaller denomination coin receiving openings configured to receive smaller denomination coins and a larger denomination coin receiving opening configured to accept a larger denomination coin, the lever checking mechanism comprising:

a plurality of small denomination coin levers connectable to the body and configured so that smaller denomination coins positioned in the small denomination coin receiving openings of the slide move each of the small denomination levers from a slide catch position to a slide release position as the slide is moved toward the vending position from the coin receiving position, in the slide catch position at least one of the small denomination coin levers engages the slide so as to prevent the slide from passing to the vending position while in the slide release position each of the small denomination coin levers are positioned to permit the slide to pass to the vending position; and a large denomination coin lever connectable to the body and configured so that a larger denomination coin positioned in the large denomination coin receiving opening of the slide moves the large denomination lever from a slide catch position to a slide release position as the slide is moved toward the vending position from the coin receiving position, in the slide catch position of the large denomination coin lever at least one of the small denomination coin levers engages the slide so as to prevent the slide from passing to the vending position while in the slide release position of the large denomination coin lever the large denomination coin lever communicates with each of the small denomination coin levers causing each of the small denomination coin levers to be positioned to permit the slide to pass to the vending position as if the plurality of smaller denomination coins had been inserted into the smaller denomination coin openings of the slide such that the slide is permitted to be moved from the coin receiving position to the vending position by inserting the larger denomination coin into the slide in lieu of the plurality of smaller denomination coins.

14. The coin slide of claim 13 wherein large denomination coin lever has a bar on one end thereof positioned to engage each of the small denomination coin levers when the large denomination lever is moved to the slide release position thereby causing each of the small denomination coin levers to be positioned to permit the slide to pass to the vending position as if the plurality of smaller denomination coins had been inserted into the smaller denomination coin openings of the slide.

15. The coin slide of claim 14 wherein each of the small denomination coin levers includes a notch on one end thereof for receiving the bar of the large denomination coin lever.

16. The coin slide of claim 15 wherein each of the small denomination coin levers is biased in the slide catch position and wherein the large denomination coin lever is biased in the slide catch position.

17. The lever checking mechanism of claim 15 wherein large denomination coin lever further includes a bar for depressing the all of the small denomination levers thereby allowing the slide to be moved from the coin receiving position to the vending position.

18. The lever checking mechanism of claim 16 wherein the plurality of small denomination coin levers further include a notch for accepting the bar of the large denomination coin lever.

* * * * *